US007338316B2

(12) United States Patent
Blickle

(10) Patent No.: US 7,338,316 B2
(45) Date of Patent: Mar. 4, 2008

(54) CONNECTOR FOR JOINING CABLE CONDUCTORS WITH AN ANTENNA

(75) Inventor: Günther Blickle, Neustetten (DE)

(73) Assignee: Hirschmann Car Communication GmbH, Neckartenzlingen (DE)

( * ) Notice: Subject to any disclaimer, the term of this patent is extended or adjusted under 35 U.S.C. 154(b) by 0 days.

(21) Appl. No.: 11/262,478

(22) Filed: Oct. 28, 2005

(65) Prior Publication Data

US 2006/0094294 A1 May 4, 2006

(30) Foreign Application Priority Data

Oct. 30, 2004 (DE) ..... 102004052776.8

(51) Int. Cl.
*H01R 13/73* (2006.01)

(52) U.S. Cl. ..... 439/546; 439/916

(58) Field of Classification Search ..... 439/353, 439/354, 357, 537, 544, 546, 916
See application file for complete search history.

(56) References Cited

U.S. PATENT DOCUMENTS

| | | | | |
|---|---|---|---|---|
| 5,328,388 | A * | 7/1994 | Fust et al. | 439/544 |
| 5,407,363 | A * | 4/1995 | Polgar et al. | 439/546 |
| 6,347,959 | B2 * | 2/2002 | Sawayanagi | 439/537 |
| 6,450,834 | B1 * | 9/2002 | Polgar et al. | 439/546 |
| 6,469,678 | B1 | 10/2002 | Pullen | |
| 6,568,951 | B2 * | 5/2003 | Sawayanagi et al. | 439/357 |
| 2006/0077110 | A1 | 4/2006 | Blickle | 343/713 |
| 2006/0103579 | A1 | 5/2006 | Blickle | 343/711 |

FOREIGN PATENT DOCUMENTS

| | | |
|---|---|---|
| DE | 22 57 352 | 5/1974 |
| DE | 91 02 092 | 5/1991 |
| DE | 295 00 961 | 6/1995 |
| DE | 198 02 265 | 8/1999 |
| DE | 102 55 549 | 6/2004 |
| DE | 102005044610 | 3/2006 |
| DE | 102005044611 | 3/2006 |
| DE | 200510044618 | 11/2006 |

* cited by examiner

*Primary Examiner*—Thanh-Tam Le
(74) *Attorney, Agent, or Firm*—Andrew Wilford

(57) ABSTRACT

A device for mounting an antenna on a vehicle body and for coupling cables through a hole in the body with the roof antenna the device has a base plate outside the body connected with the roof antenna at the hole in the vehicle body and a connector mount. Body plugs and/or sockets are mounted or formed on the connector mount and provided on ends of the cables. Complementary antenna sockets and/or plugs for the connector mount are provided on the base plate. The antenna sockets and/or plugs are connected with electrical or electronic components of the roof antenna so that the connector mount is connectable before, during, or after mounting of the antenna with the complementary antenna plugs and/or sockets.

9 Claims, 3 Drawing Sheets

CONNECTOR FOR JOINING CABLE CONDUCTORS WITH AN ANTENNA

FIELD OF THE INVENTION

The invention relates to a device for mounting an antenna, in particular a roof antenna, on a vehicle body and for connecting cables with the roof antenna, the device having a base plate outside the body connected with the roof antenna and with a hole in the vehicle body.

BACKGROUND OF THE INVENTION

Such a mount for a roof antenna on a vehicle body is described in German patent application 10 2005 044 610 (US equivalents 2006/0077110 and 2006/0103579). With this device one or more connector cables, in particular HF connector cables with plugs on their ends, must be threaded through holes in a base plate and in a bayonet plate. For mounting the antenna these connector cables have to be painstakingly threaded by hand one after the other through the opening of the vehicle body into its interior before the roof antenna can be mounted in the provided manner on the vehicle body.

Normally after the roof antenna is in place connectors on the vehicle feed cable are individually secured to the feed cables and the wires are then clipped in place so they are tight. This installation is difficult since first the antenna must be set from above on the vehicle body (roof) and positioned before the individual plugs and sockets can be fitted together from below.

As a result of this connection of the cables and plugs inside the body it is difficult or impossible to remove the antenna from outside, since there is not enough slack in the cables to allow them to be pulled out of the roof opening without disconnecting them. If the conductors are left long enough, there is the danger that they will rattle or their loops will be damaged when the vehicle is in use.

OBJECT OF THE INVENTION

It is thus an object of the invention to eliminate these problems and so to improve on and develop the system for mounting the antenna that it is simple to connect the cables with the antenna. In this manner costs will be reduced, installation will be simplified, and it will be possible to fully disconnect the roof antenna from the connector cables.

SUMMARY OF THE INVENTION

This object is achieved in that the ends of the cables are provided with plugs and/or sockets that are mounted or formed on a connector mount, that the base plate is provided with sockets and/or plugs for the connector mount that are themselves connected with electrical or electronic components of the roof antenna so that the connector mount is connectable before, during, or after mounting of the antenna with the complementary antenna plugs and/or sockets.

With this construction of the invention, the cables do not have to be individually fitted by hand through the roof hole. There is no need to plug in the individual cables. This is taken care of by the central plug connection.

The connector mount on its output side, that is toward the electronic device connected to it such as a signal booster or the like, carries the plugs and/or sockets that fit with sockets and/or plugs of the antenna. This one-piece element makes electrical hookup very fast, since only a single part, namely the connector mount, must be fitted from below with the antenna, which can take place before, during, or after mounting the antenna on the vehicle body. A further advantage of the connector mount is that it can be prefabricated with the cable harness where the other cable ends have the necessary sockets and/or plugs or is directly connected with its electronic equipment.

The use of the connector mount and the mounting of the antenna on the vehicle body, in particular a roof antenna on the roof of a motor vehicle, allows for some variation. So for example a roof antenna is provided with a base plate that has a downwardly projecting threaded pin that fits through a hole in the vehicle body and is provided thereunder with a nut. If concentrically around this threaded pin on the base plate or sticking through it there are plugs and/or sockets, the connector mount according to the invention can simply be fitted in from below after the roof antenna is mounted so that the connection is made.

Alternatively it is possible that the connector mount is first mounted on the vehicle body, in particular underneath the vehicle roof, so that when the roof antenna is fitted down on the vehicle roof with the threaded pin extending through the opening in the vehicle roof, the connection is made and after fitting the roof antenna on the vehicle roof the mounting nut is tightened to hold it. To this end the connector mount is fitted coaxially around the threaded pin and can even have another shape, e.g. square, rectangular, or the like.

If the roof antenna is mounted on the vehicle roof by a system such as described above (see for example DE 10 2005 044 618.3 and WO 2006/108589) the connector mount of this invention works equally well. Thus after solidly mounting the roof antenna on the vehicle roof the connector mount is fitted, it also being possible to premount the connector mount underneath the vehicle roof and connect up its plugs and/or sockets during installation of the roof antenna, the connections being fitted together when the roof antenna is fixed to the vehicle roof. It is also possible to so construct and install the various elements that the connector mount is pressed by a clamping plate from below against the underside of the vehicle roof during mounting, for example by screwing. The mounting, that is the actual retaining with a clamping plate, can be done either from inside the vehicle or from above the roof.

Furthermore the connector mount according to the invention can use a roof mount on a vehicle roof as for example in DE 10 2005 044 610.8 where the roof antenna is mounted by a bayonet connection and a rotary mounting step or in DE 10 2005 044 611.6 where the roof antenna is mounted on the vehicle roof by a combined linear and rotational movement. With both of these two mounting styles the connector mount can be fitted on the vehicle roof after mounting on the vehicle roof or alternatively the connector mount can move with the roof antenna during the installation and then be secured in its final position. This means in other words that the connector mount, regardless of how the type of antenna is secured on the vehicle roof (or elsewhere on the vehicle body), is installed and connected only after or before installation and takes part in the installation steps or even is fixed underneath the vehicle roof and the connections, e.g. the fitting-together of plugs and sockets, are made during installation.

In the following it is assumed that the roof antenna has a bayonet mount, it being understood that the other described mounting styles are within the scope of the invention.

Thus it is understood that the steps used to mount the antenna on the vehicle body can be done in reverse order to remove the antenna from the vehicle body. In the simplest embodiment of the invention, after installation the connector mount is simply disconnected from underneath from the antenna so that the antenna can be uninstalled. If the connector mount partially moves during installation, this movement is reversed for uninstallation. Alternatively it is possible that after mounting the connector mount on the underside of the antenna, it is simply pulled off before uninstalling the antenna.

The connector mount preferably has on its side turned away from the connector cables mounting elements, in particular hooks, that fit between the bayonet notches and/or tabs in the hole. In this manner the connector mount can be mounted as a separate part in the vehicle body so that it is easy to connect the mount and the base plate or bayonet plate.

In a further embodiment of the invention the mounting elements are oriented opposite to the rotation direction for tightening the base plate and/or the bayonet plate of the roof antenna. Thus the connector mount is twisted after fitting together the plugs and sockets to lock the antenna in the hole.

Preferably the connector mount has at least one centering element that fits with the generally circular hole so that the connector mount is centered in the hole. It is possible also to have several guide elements that fit the central hole.

In order to be able to freely move the antenna, in particular the base plate and the bayonet plate, the connector mount has a cutout for the screw connection with a bolt so that the base plate and the bayonet plate can be set deeply enough through the hole.

It is further suggested that the positions of the plugs and sockets on the connector mount and on the base plate or bayonet plate are so set angularly relative to each other that when the plugs and sockets are engaged together the bayonet tabs of the bayonet plate are positioned adjacent the mounting elements, preferably immediately next to them. This means that after the connector mount is set in the hole in the vehicle body, the bayonet tabs are angularly positioned such that after fitting together of the plugs and sockets they fit in the bayonet notches.

It is further suggested that the connector mount be constructed to fix the antenna on the vehicle body. To this end the connector mount not only serves for the electrical connection during or after mounting on the vehicle body, in particular on the vehicle roof, but also serves for its mechanical fixation. This means that the connector mount for example is part of the bayonet disk (with or without holding spring) and forms a single part therewith. With a one-part bayonet-plate/connector-mount a single action serves to both electrically connect and mechanically secure the antenna. Alternatively the connector mount can be for example part of a mounting plate that is axially moved (for example from below against the underside of the vehicle roof) against the base plate of the roof antenna to mechanically secure and electrically connect to it. The securing means can be a snap connection, latch, screw connection, clamp, or the like or advantageously any mounting type that ensures a permanent and sure (unmoving) connection, that is however releasable for repairs.

The method of connecting an antenna with feed cables and mounting the antenna on the vehicle body is effected in that the connector mount is set in the hole of the vehicle body such that the hooks engage outside the hole on the bayonet tabs, that the sockets and plugs of the connector mount and of the base plate or bayonet plate are fitted in each other, the bayonet lugs of the bayonet plate are passed through the bayonet notches or after assembly are fitted through the bayonet notches, and the roof antenna with the base plate is turned such that the roof antenna is clamped to the vehicle body.

BRIEF DESCRIPTION OF THE DRAWING

An embodiment of the invention, to which it is not limited, is shown in the drawing and described below. Therein.

SPECIFIC DESCRIPTION

Figure 1:
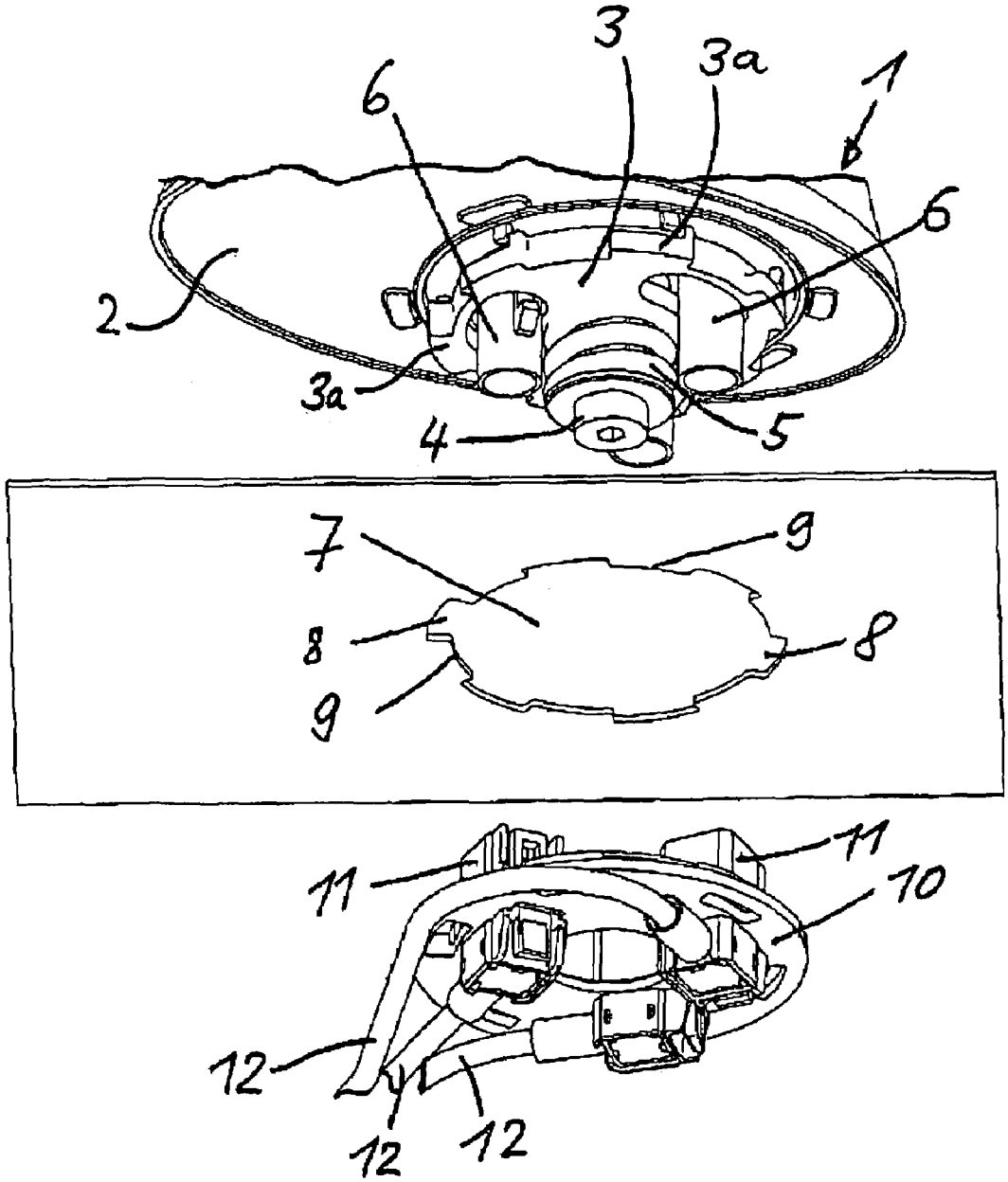
FIG. 1 is an exploded view of a roof antenna, an opening in a vehicle body, and a connector mount.
Figure 2:
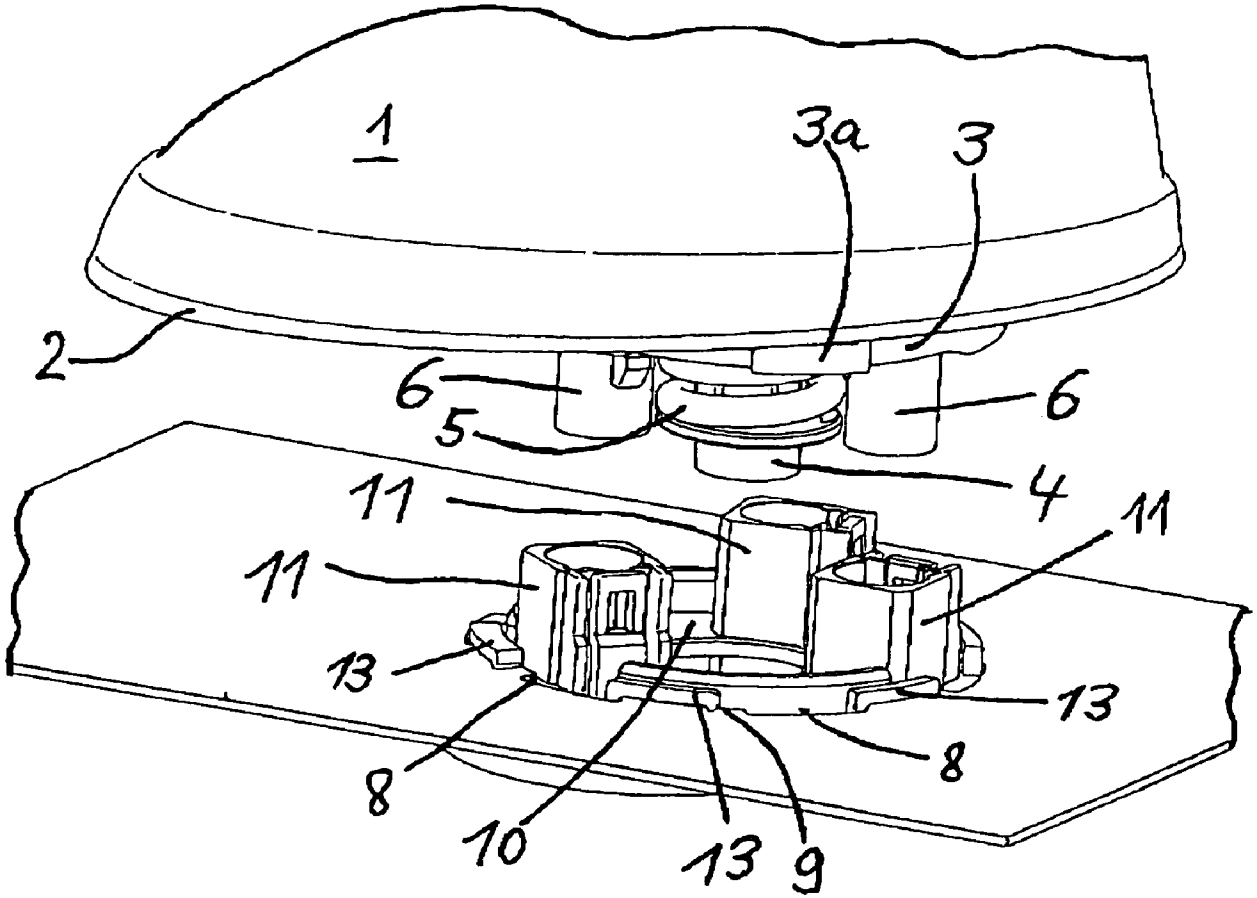
FIG. 2 is a view of a vehicle-body portion with the installed connector mount and, above it, the roof antenna.
Figure 3:
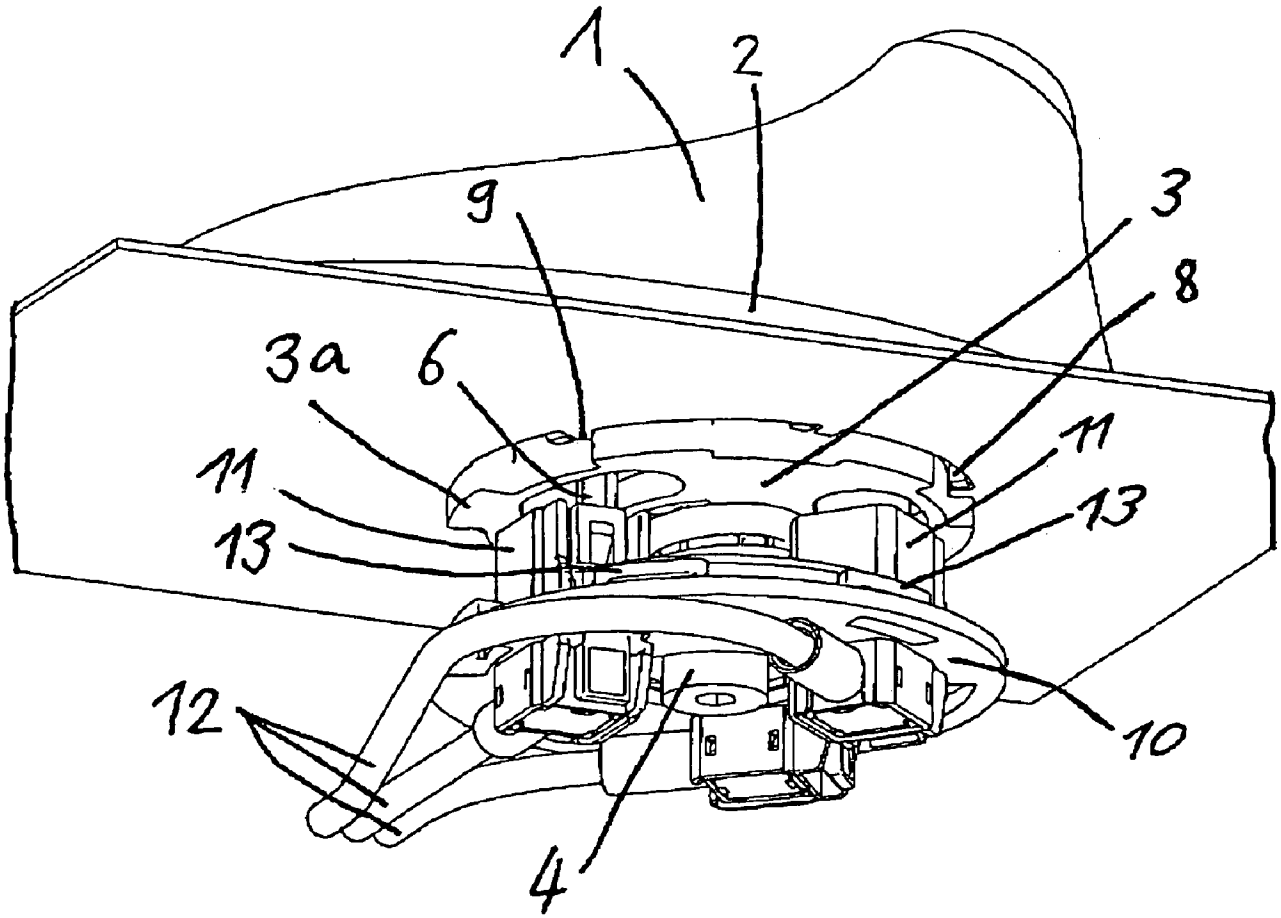
FIG. 3 is a roof antenna in fully mounted condition with connected cables seen from inside the vehicle body.

FIGS. 1 to 3 show a roof antenna 1 having a base plate 2 juxtaposed with a vehicle body. A bayonet plate 3 is pressed by a screw 4 and a spring 5 against the base plate 2. The bayonet plate 3 has on its outer periphery outwardly projecting bayonet lugs 3*a*.

The details of the device for mounting the roof antenna on the vehicle body are not described in detail since they are part of the older patent applications of applicant cited above.

In addition the base plate 2 carries plugs 6 that project through holes in the bayonet plate 3. The plugs 6 are connected with unillustrated electrical or electronic components inside the antenna. The vehicle body is formed with a hole 7 that has on its periphery bayonet notches 8 and tabs 9. A connector mount 10 is provided that is generally disk-shaped and that has sockets 11 that are mounted or fixed on the connector mount 10 and that contain the necessary and standard parts for transmitting a HF signal. The sockets or their inner connectors are connected to cables 12 that extend off to unillustrated locations inside the vehicle. Since the connector mount 10 is fixed in the hole 7 of the vehicle body and is here connected with the plugs 6, it is not necessary to provide slack in the connector cables 12 so that they can be solidly anchored inside the vehicle body and rattling or chafing is avoided. The connector mount 10 has on its side (see FIG. 2) turned away from the connector cables 12 hooks 13 that can engage through the bayonet notches 8 and can be brought into engagement on the outside of the vehicle by rotation behind the tabs 9 to hook there. The bayonet notches 8 are angularly wide enough that they can accommodate both the bayonet lugs 3*a* of the bayonet plate 3 and the connecting legs of the hooks 13 of the connector mount 10. To this end it is necessary to provide inside the vehicle body sufficient height for the connector mount 10.

It should be noted that the above-given embodiment is only one of many possible ways to make a connector mount according to the invention. It can also be constructed as a mounting system that is described briefly with reference to a clip connection. A clamping plate is secured underneath a vehicle roof when for example a screw is threaded from above the roof into the clamping plate. In this manner the clamping plate and the base plate of the roof antenna are drawn toward each other and thus grip the vehicle roof so that the roof antenna is fixedly mounted on the vehicle roof. Simultaneously the clamping plate, which can be square, rectangular, oval, or the like, can also be concentrically mounted with the connector mount (or the two can be one piece) that carries the plugs and/or sockets. Axial movement of the clamping plate and base plate toward each other fits the plugs and/or sockets with the complementary plugs and/or sockets of the roof antenna. This installation system applies for roof after mounted as well as premounted clamp-plate/connector-mount systems.

The invention claimed is:

1. A device for mounting a roof antenna on a vehicle body and for coupling cables through a hole in the body with the roof antenna, the device comprising:

a base plate outside the body connected with the roof antenna at the hole in the vehicle body;

a connector mount inside the vehicle body at the hole of the vehicle body and formed with a hole;

a screw connection and a spring extending from the base plate through the hole in the vehicle body and the hole in the connector and securing the base plate to the connector mount;

body plugs and/or sockets mounted or formed on the connector mount and provided on ends of the cables; and complementary antenna sockets and/or plugs for the connector mount and provided on the base plate, the antenna sockets and/or plugs being connected with electrical or electronic components of the roof antenna so that the connector mount is connectable before, during, or after mounting of the antenna with the complementary antenna plugs and/or sockets.

2. The device according to claim 1 wherein the connector mount is fixable in or on the vehicle body.

3. The device according to claim 1 wherein the connector mount has on a side turned away from the cables mounting elements that serve for mounting the connector mount in the hole.

4. The device according to claim 3 wherein the mounting elements fit with bayonet notches and/or tabs in the hole of the vehicle body.

5. The device according to claim 3 wherein the mounting elements are oriented opposite to a rotation direction for tightening the base plate and/or the bayonet plate of the roof antenna.

6. The device according to claim 1 wherein the hole is generally circular and connector mount has at least one centering element that fits with the generally circular hole.

7. The device according to claim 1 wherein the sockets and plugs are so angularly positioned on the connector mount and on the base plate or bayonet plate that after the sockets and plugs are fitted together the bayonet lugs of the bayonet plate are positioned adjacent the mounting elements.

8. The device according to claim 1 wherein the connector mount is constructed as a mount for securing the roof antenna on the vehicle body.

9. In combination with a motor-vehicle body formed with a hole, a device for mounting a roof antenna comprising:

a bayonet plate arranged inside the motor-vehicle body at the hole;

a base plate of the antenna outside the motor-vehicle body at the hole;

a screw connection and a spring extending through the hole between the base plate and the bayonet plate, the hole in the vehicle body being generally circular and having bayonet notches and tabs complementary to bayonet lugs of the bayonet plate;

guide elements between the base plate and the bayonet plate that permit limited relative rotation of the base plate and the bayonet plate, such that relative rotation of the base plate and the bayonet plate secures the roof antenna on the vehicle body;

a connector mount having plugs or sockets; and connector cables connected with the plugs or sockets on the connector mount, the base plate and/or the bayonet plate having turned toward the connector mount complementary antenna sockets or plugs that are connected with electrical or electronic components of the roof antenna, the connector mount being mountable at least during connection of the plugs with the sockets on or in the hole in the vehicle body.

* * * * *